United States Patent [19]

Mizutani et al.

[11] 4,084,336

[45] Apr. 18, 1978

[54] VIBRATOR EQUIPPED GRAB BUCKET

[75] Inventors: Yutaka Mizutani, Toyonaka; Takashi Aoki, Kochi, both of Japan

[73] Assignee: Kensetsu Kikai Chosa Kabushiki Kaisha, Osaka, Japan

[21] Appl. No.: 705,832

[22] Filed: Jul. 16, 1976

[30] Foreign Application Priority Data

Jul. 17, 1975 Japan ..... 50-86723

[51] Int. Cl.[2] ..... E02F 3/44; B66C 3/02

[52] U.S. Cl. ..... 37/184; 37/71; 37/DIG. 18; 74/87; 173/49; 404/117

[58] Field of Search ..... 74/61, 87; 259/DIG. 42; 166/177, 249; 175/55; 173/49; 404/117; 37/DIG. 18, 71, 183 R, 183 A, 184–188; 172/40

[56] References Cited

U.S. PATENT DOCUMENTS

| | | | |
|---|---|---|---|
| 1,674,392 | 6/1928 | Flansburg | 37/DIG. 18 |
| 2,892,353 | 6/1959 | Harshberger | 175/55 X |
| 3,523,614 | 8/1970 | Walker | 37/71 X |
| 3,722,381 | 3/1973 | Tuneblom | 74/87 X |
| 3,896,952 | 7/1975 | Yokota et al. | 37/187 X |
| 4,012,856 | 3/1977 | Schwarz | 37/DIG. 18 |

FOREIGN PATENT DOCUMENTS

| | | | |
|---|---|---|---|
| 192,086 | 4/1967 | U.S.S.R. | 37/DIG. 18 |

*Primary Examiner*—Clifford D. Crowder
*Attorney, Agent, or Firm*—Cushman, Darby & Cushman

[57] ABSTRACT

A grab bucket for a grab dredger having a vibrator of waterproof construction mounted on the interior of a bucket shell for causing forced vibration of the grab bucket.

1 Claim, 11 Drawing Figures

VIBRATOR EQUIPPED GRAB BUCKET

BACKGROUND OF THE INVENTION

This invention relates to improvements in or relating to a grab bucket for grab dredger. This grab dredger, popularly called Priestman, has one or more cranes mounted on the dredger to suspend one or more grab buckets. The grab bucket which is freely opened or closed is submerged into water to dig bottom ground and then lifted with earth contained therein. The grab dredger is generally used for dredging mud and sand, and it is also used with a crusher or blasting method for dredging soft and hard rocks. However, it is well known that operating efficiency in dredging hard soil and gravels is less than that in dredging the above-mentioned kind of soil. To overcome this problem, the bucket weight is greatly increased — generally five times the normal weight, which results in the significantly increased construction cost.

SUMMARY OF THE INVENTION

Accordingly, it is an object of the present invention to provide a grab bucket that can perform dredging work on soil of various kinds with a minimized bucket weight. It is another object of the present invention to provide a grab bucket that can perform dredging work at low construction cost even on hard soil and gravels — more specifically hard or fat ground or both such as hard sandy ground, gravels and hard clay type soil.

BRIEF DESCRIPTION OF THE DRAWINGS

FIG. 2 is an elevational view of the vibrator.

FIG. 3 is a side elevation of the vibrator.

FIG. 4 is a vertical section taken on line IV — IV of FIG. 3.

FIG. 5 is a partially enlarged view of FIG. 4, showing detail of water-sealing means.

FIG. 6 is a vertical section showing another embodiment of the water-sealing means illustrated in FIG. 5.

DETAILED DESCRIPTION OF THE PREFERRED EMBODIMENTS

As shown in FIG. 7, a grab bucket 13 of the present invention is suspended by ropes from a crane 11. The crane and a winding machine are installed on a dredger 12. The winding machine lifts, lowers, opens and closes the grab bucket 13 by winding or unwinding ropes.

The grab bucket is of a well-known dual-rope type which controls a supporting rope and an opening/closing rope for lifting/lowering of the grab bucket and for opening/closing of the shells.

Figure 1:
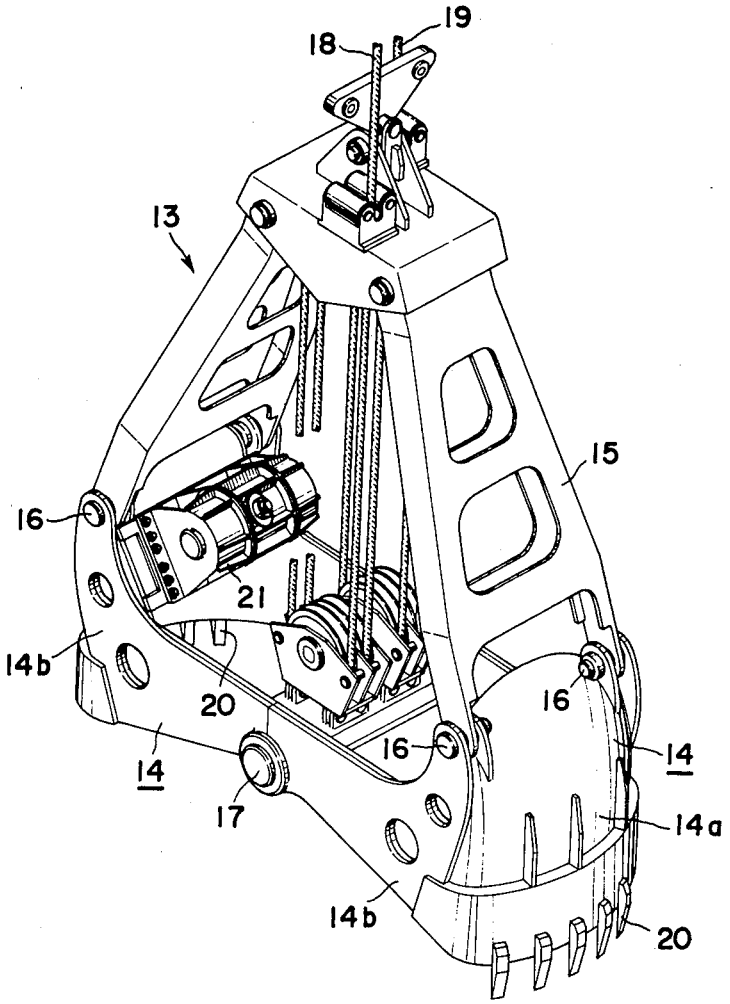
FIG. 1 is a perspective view of a grab bucket of the present invention.

FIG. 1 shows the opened grab bucket or opened shells. Each shell 14 comprises a bottom wall 14*a* and side walls 14*b* being extended from the bottom wall on both sides thereof. The bottom wall 14*a* is jointed with the frame 15 by pins 16 passing the side walls, frame and lugs provided on the bottom wall 14*a*. The side walls are connected by a shaft 17 so tbhat the shells rotate about the shaft for opening/closing the bucket when the shaft 17 is lifted or lowered. A supporter wherein two couples of pulleys are provided is fixed on the shaft 17. The supporting rope 18 and opening/closing rope 19 are separately wound around each couple of pulleys.

The shells are opened as shown in FIG. 1 when the opening/closing rope is lowered, keeping the supporting rope stopped. Under this condition, the bucket can be lifted or lowered with the shells opened by lifting or lowering the ropes 18 and 19 simultaneously. When only the rope 19 is lifted, the shell can be closed. In addition, when both ropes 18 and 19 are lifted, the shells can be lifted, keeping open condition. Teeth 20 are provided on one side of the bottom wall opposite to the shaft 16 side in such a manner that the teeth dig in earth when the opened shells drop, and hold earth therein when the shells are closed. This detailed mechanism is well known among engineers in the concerned field.

The grab bucket of the present invention has a vibrator 21 that is attached to one of the above-mentioned shells of the bucket. This vibrator is positioned so that it is above the teeth 20 when the shells are opened. More specifically, the vibrator is fixed to a bearer which is bridged and fixedly secured between side walls 14 (*b*), that is, on the interior of the shell as shown in FIG. 1, and positioned adjacent to the shaft 16 in order to effectively transmit vibration caused by the vibrator to the teeth and minimize reduction of the bucket capacity.

Figure 2:
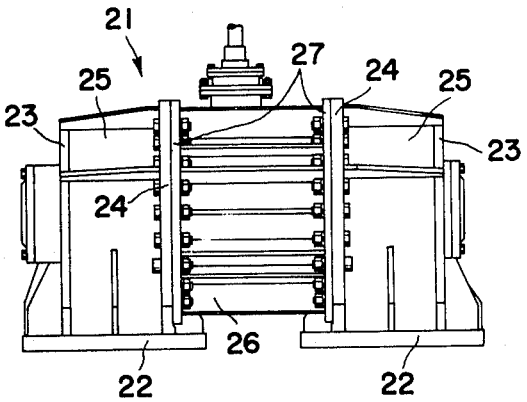
FIG. 2 to FIG. 6 are detail views of a vibrator mounted to the grab bucket shown in FIG. 1.
Figure 3:
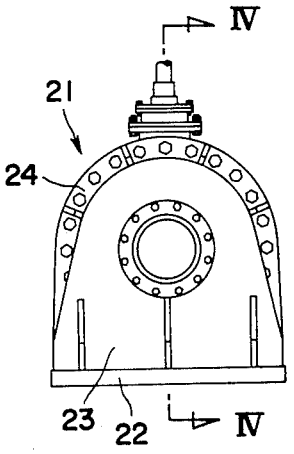
Figure 4:
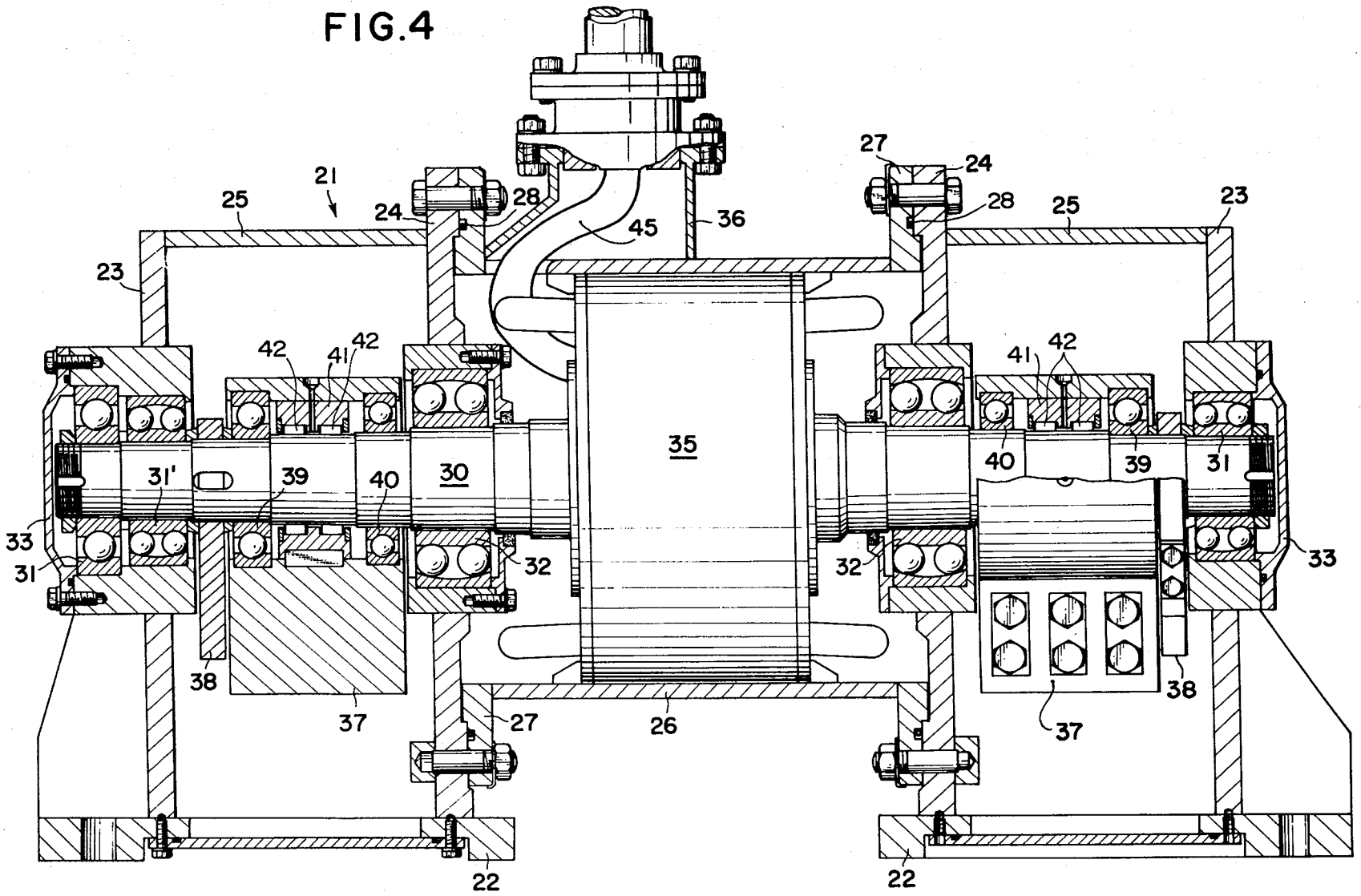

In the vibrator, a weight is eccentrically mounted on a shaft to induce great impact force when the shaft rotates, and to minimize the vibrator size. FIG. 2 to FIG. 4 show detail of the vibrator.

A casing comprises three compartments. Two side compartments each constitute a sealed hollow box which is composed of two walls 23 and 24 being placed in parallel to each other on a base plate 22 and a cover 25 being connected therewith to form the hollow box. A central compartment is a hollow cylinder in whole, and flanges 27 on both sides of a cylinder 26 are bolted to the walls 24 of the side compartments. The flanges of the central compartment are provided with grooves wherein O-rings are inserted to protect the central compartment from entry of water. The side compartments are opened or closed by dismounting or mounting the covers which are fixed to the base plate 22 by screws with O-rings provided therein for water-seal.

A rotating shaft 30 passes through all three compartments, and is rotatably secured by bearings 31, 31' and 32 which are attached to each of walls of the side compartments. Ends of the bearings fixedly secured to the end walls 23 and ends of the rotating shaft 30 are enclosed by covers 33 which are fixedly secured to bearing-supporting members and sealed with O-rings.

The rotating shaft is driven by a motor 35 which is housed in the casing constituting the central compartment. To keep the vibrator in compact size, a rotor of the motor 35 is directly fixed on the rotating shaft 30, and a stator is positioned around the rotor and fixedly secured to the inside of the cylinder 26 of the central compartment. As a result, the rotating shaft 30 is directly driven by the motor without reduction gear. A cable 45 which connects the motor to the power supply through a controller is led to outside through an outlet 36 and a water-sealing box 46 provided on the central compartment of the casing.

Figure 5:
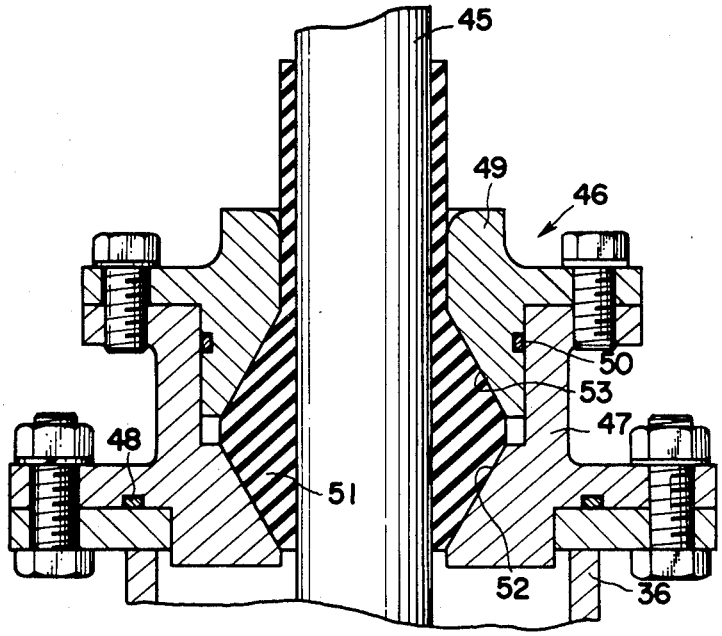

FIG. 5 shows detail of the water-sealing box 47. The box 40 is fixedly secured to the casing so that a flange of the box 40 is bolted to the flange of the outlet 36. An O-ring 48 is provided between both flanges for sealing. A cap 49 is fixedly secured to the box 47 so that a flange of the cap 49 is bolted to the opposite flange of the box 47 with an O-ring provided in between for sealing. A seal material 51 is charged in a space being formed by the box, cap and cable. This seal material 51 is made of water-resistant or seawater-resistant rubber whose outside surface is deformed for matching conical surfaces 52 and 53 of the box and cap in order to achieve pressed sealing. The cable 45 is pressure inserted into the seal material for achieving water-sealing between them.

Figure 6:
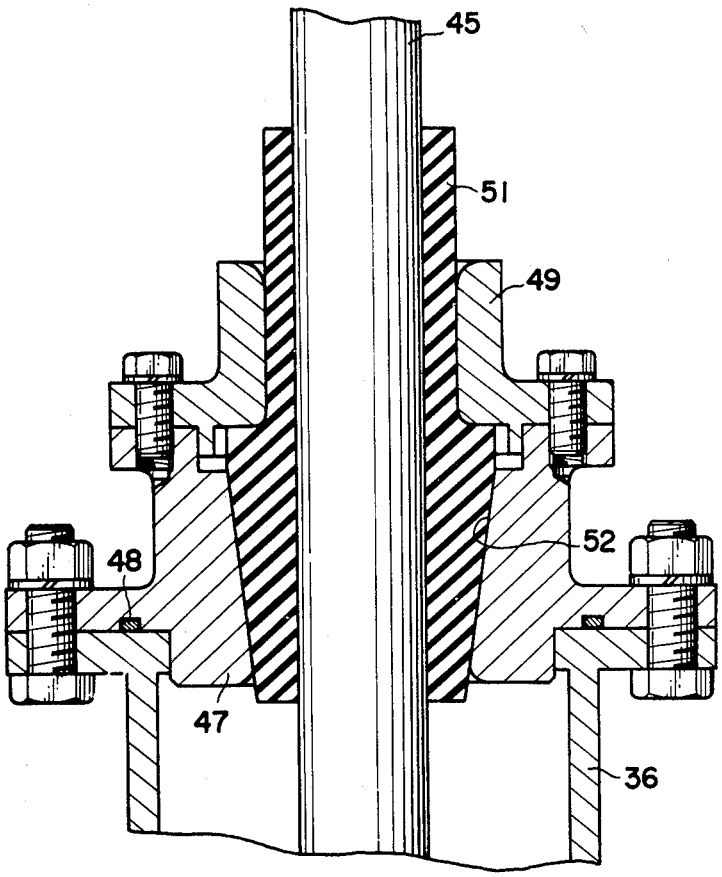
Figure 7A:
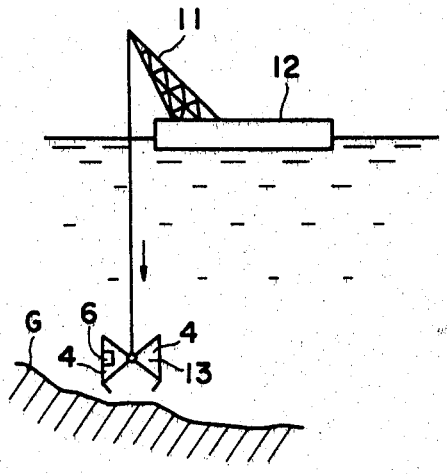
FIG. 7 (*a*), (*b*), (*c*) and (*d*) show a dredger equipped with the grab bucket of the present invention, and explain dredging work in the operating sequence of FIG. 7 (*a*) to FIG. 7 (*d*).
Figure 7B:
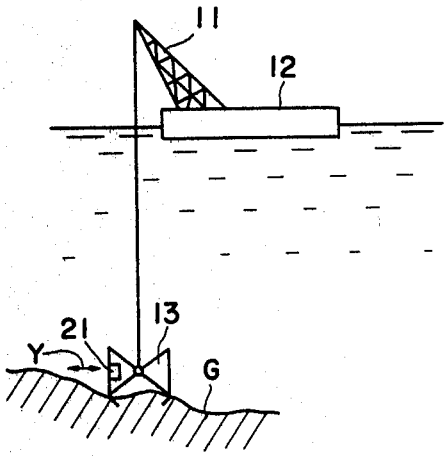
Figure 7C:
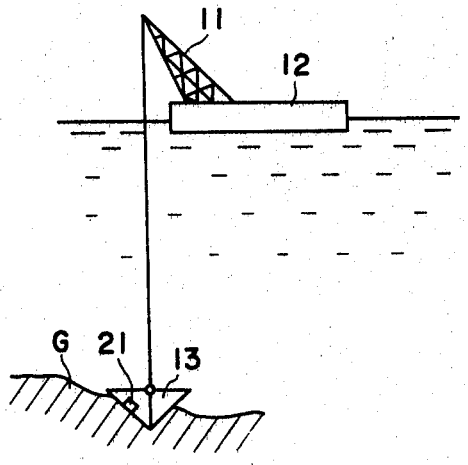
Figure 7D:
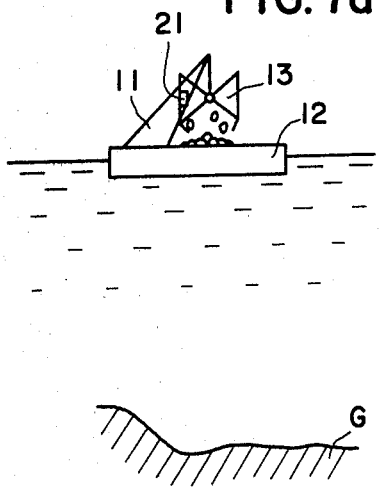

FIG. 6 shows another embodiment of the water-sealing box. Similar to the above-mentioned embodiment, in this arrangement, a box 47 is flanged to an outlet 36, and a cap 49 is flanged to the box 47, all of joints being sealed. A seal material 51 wherein the cable 45 is press inserted is engaged with tapered inner surface of the box and pressed down by the cap, thus protecting the casing from entry of water.

As shown in FIG. 4, each of two side compartments has a couple of eccentric weight plates consisting of a primary weight plate 37 and a secondary weight plate 38 having weight less than the primary weight plates. Since the weight plate are eccentrically mounted on the rotating shaft 30, circular vibration occurs when the rotating shaft rotates, which transmits to the shell 14.

The primary weight plate is attached to the rotating shaft through bearings 39 and 40. In addition, a clutch is provided between the primary weight plate and the rotating shaft in order to rotate the primary weight plate with the rotating shaft in a required direction. The clutch is of well-known sprag type wherein a sprag 42 that is clamped by a retainer provided between the rotating shaft and an outside ring 41 fixed to the weight. On the other hand, the secondary weight plate 38 is directly affixed to the rotating shaft. Therefore, when the rotating shaft 30 rotates in one direction, circular vibration due to two weight plates occurs at the same time, while when the rotating shaft 30 rotates in opposite direction, circular vibration due to only the weight plate 38 occurs.

Each of side compartments of the casing contains lubricating oil for splash lubrication for bearings at weight rotation.

Dredging method by a dredging apparatus using the abovementioned grab bucket will described with reference to FIG. 7.

At first, the dredger 12 is kept in place for dredging. Then, the grab bucket 13 is lowered to the bottom G as shown in FIG. 7(*a*). At this time, the motor 35 starts to rotate the rotating shaft 30 in normal direction to induce great vibromotive force due to rotation of both the primary weight plate 37 and secondary weight plate 38, which transmits to the shell 14. As shown in FIG. 7(*b*), the shell is vibrated in a direction of Y so that the teeth 5 break the ground G while weakening the ground, and the shell is inserted into the ground. After that, as shown in FIG. 7(*c*), the shell is closed to hold earth, gravels and rocks therein while vibrating the shell. Finally, as shown in FIG. 7(*d*), the grab bucket is lifted above the dredger, and opened to dump earth, gravels and rocks onto the dredger 12. When clay type soil is deposited inside the shell, the rotating shaft 30 is rotated in reverse direction by reversing the motor rotation, so that only the secondary weight plate 38 rotates, which induces small vibration being transmitted to the shell, thus deposited soil being vibrated and removed from the shell.

To eliminate trouble and breakage of the bucket, and let the teeth dig smoothly in the ground during digging operation, it has been found that vibrating acceleration of two to three $q$ is necessary based on actual experience. To achieve this end, the vibrator is needed to cause vibromotive force that is two or three times the bucket weight. Also, the required amplification is at least 3 mm.

Vibration acceleration is defined as $\mu = Po/Qo$; where, $\mu$ is vibration acceleration, Qo is vibration weight, and Po is vibromotive force. This vibromotive force is defined as $Po = Kw^2/g$; where, K is eccentric moment, $w$ is angular speed, and $g$ is gravitational acceleration. Furthermore, amplification is defined as $A = K/Qo$; where, A is amplification, K is eccentric moment, and Qo is vibration weight.

Figure 8:
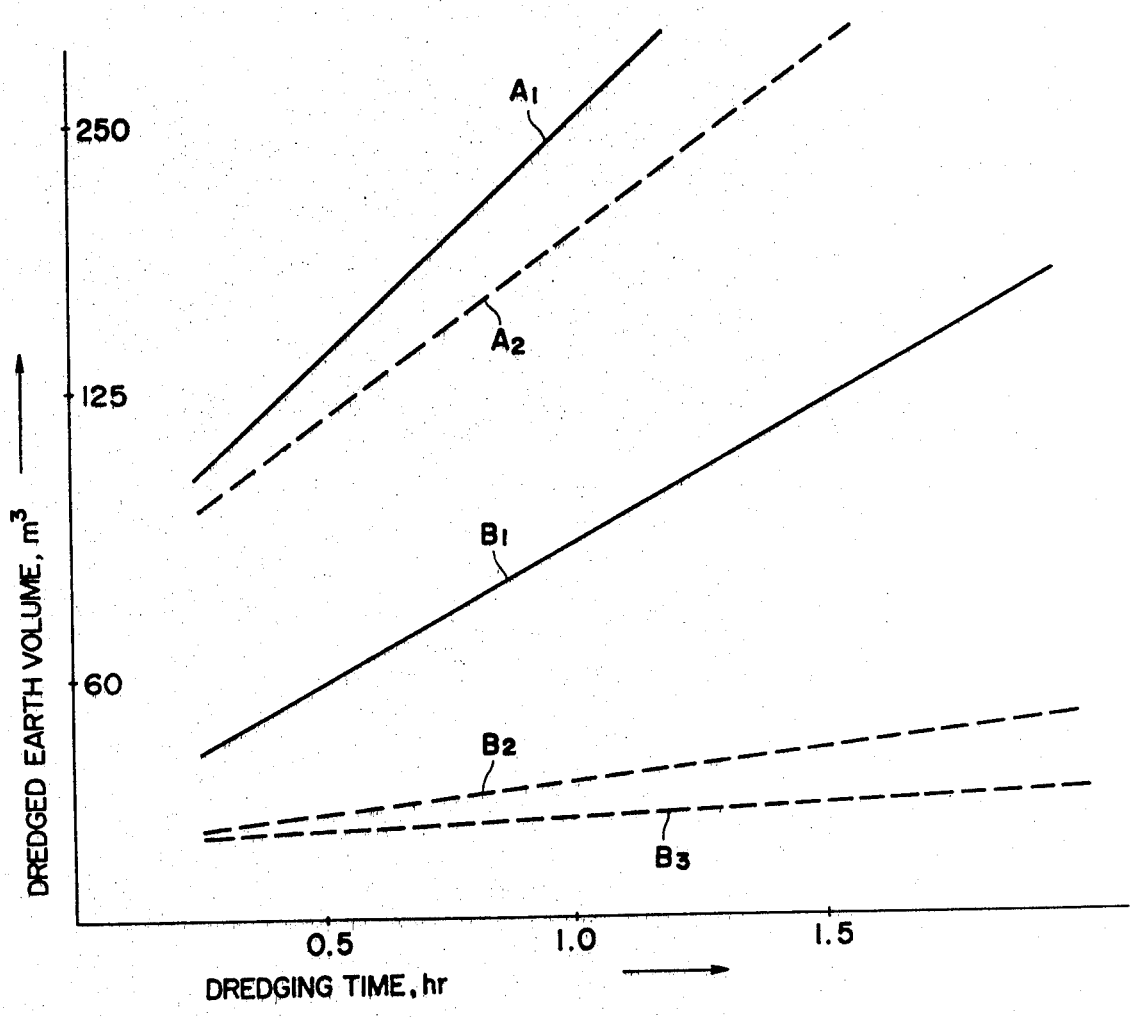
FIG. 8 is a graph or diagram showing general relationship between dredging time and dredgng volume per operation using grab buckets of the present invention and prior art, which is separately illustrated according to kinds of soil.

As for operating efficiency, FIG. 8 shows relationship between dredged earth volume and dredging time, which is separately illustrated according to kinds of earth. In FIG. 8, solid line indicates the grab bucket of the present invention, dotted line indicates the prior art grab bucket, straight lines A1 and A2 indicate soft soil such as muddy soil and sand, and straight lines B1, B2 and B3 indicate hard soil such as hard ground and gravels.

From FIG. 8, it is clearly understood that the use of the grab bucket of the present invention improves operating efficiency on soft ground. In particular, it is apparent that operating efficiency by the grab bucket of the present invention is extremely high on hard ground compared with that by the prior art grab bucket even used with a crusher.

However, when referring to FIG. 8, care should be exercised to ensure that operating efficiency is largely varied according to dredging conditions and experience or skill of the operator. Moreover, care should be taken to ensure that FIG. 8 is prepared on the basis of a lot of separate dredging data.

As described above, since the grab bucket of the present invention deeply digs in the ground with the shell being subject to forced vibration while weakening adjacent ground by the forced vibration of the shell, it improves operating efficiency compared with conventional grab bucket that digs into the ground with the shell being simply subject to its own weight. Moreover, durability of the grab bucket is also improved because there is no necessity of increase of grab bucket weight, forced penetration of the shell into the ground, and forced opening/closing of the shell in the ground. In addition, it is expected that the grab bucket of the present invention offers efficient dredging work and safety operation on soft rocks without need for a crusher and blasting.

What is claimed is:

1. A grab bucket having a pair of openable and closable shells with each shell having a bottom wall and parallel side walls extending from said bottom wall, a frame, each bottom wall having means pivotably attaching one end thereof to said frame, a shaft, each side wall of each said shells having one end thereof pivotably mounted on said shaft, each said shell having another end and teeth fixed to said another end, said bottom and side walls of each shell defining an interior portion thereof, one of said shells having vibrator means secured between said side walls on said interior portion of said shell so that, when said shells are opened, said vibrator means is disposed above said teeth of said shell, said vibrator means comprising a water-tight casing, a shaft member rotatably secured to said casing through bearings, an electric motor having a rotor fixed on said shaft intermediate the ends thereof and a weight mounted eccentrically on each end of said shaft, each said weight comprising a stator housed in said casing, a pair of weight plates, each weight plate of each pair of weight plates having a different weight from the other weight plate of its pair, one weight plate of each pair being secured on said shaft through a one-way clutch and the other weight plate of each pair being fixedly secured on said shaft so that said two weight plates of each pair rotate simultaneously with said shaft in one direction, while only one weight plate of each pair rotates with said shaft in the opposite direction.

* * * * *